United States Patent [19]

Doyle

[11] 4,194,202

[45] Mar. 18, 1980

[54] GRID PULSED OSCILLATOR AND DETECTOR

[75] Inventor: William E. Doyle, Rockville, Md.

[73] Assignee: The United States of America as represented by the Secretary of the Navy, Washington, D.C.

[21] Appl. No.: 840,479

[22] Filed: Sep. 16, 1959

[51] Int. Cl.[2] ..... F42C 13/04; G01S 9/02

[52] U.S. Cl. ..... 343/7 PF; 102/214; 102/219; 307/321

[58] Field of Search ..... 343/5, 7, 11, 13, 13.1, 343/17.1, 7 PF; 102/70.2, 70.2 P, 214, 219; 307/88.5 DB, 88.5 D, 321

[56] References Cited

U.S. PATENT DOCUMENTS

| | | | |
|---|---|---|---|
| 2,532,221 | 11/1950 | Bradley | 343/17.1 |
| 2,911,639 | 11/1959 | Hopkins | 343/7 |
| 2,913,716 | 11/1959 | Powell | 343/7 |

*Primary Examiner*—Malcolm F. Hubler
*Attorney, Agent, or Firm*—R. S. Sciascia; A. L. Branning

EXEMPLARY CLAIM

5. A pulse doppler proximity fuze comprising a self-pulsing oscillator for developing a series of radio frequency electromagnetic energy impulses, an antenna electrically connected to said oscillator for radiating said impulses into space and for intercepting reflected impulses thereby to effect a variation in the amplitude of said impulses, a pair of detectors electrically connected to the said oscillator circuit for developing an output signal in proportion to the energy of the said reflected signal during the peak amplitude of said impulse, a thyratron firing circuit said detectors having means for detecting spurious signals and target signals but utilizing only the target signals for firing the thyratron firing circuit; and an electroresponsive ignition device electrically coupled to the thyratron firing circuit, said device being ignitable upon actuation of the thyratron firing circuit by said target signal.

5 Claims, 4 Drawing Figures

GRID PULSED OSCILLATOR AND DETECTOR

The invention described herein may be manufactured and used by or for the Government of the United States of America for governmental purposes without the payment of any royalties thereon or therefor.

This invention relates generally to high frequency oscillating and detecting circuitry, and more particularly to a self-pulsing oscillator and peak detector circuit having jamming operating characteristics superior to those obtained in present day circuitry of the class to which the instant invention pertains.

Although self-pulsing oscillator-detector circuits have been heretofore devised, the majority of these devices utilize radio frequency oscillations which are emitted and reflected back by an object moving relatively to the device. The reflected wave when reaching the device is picked up by the oscillator-detector circuit. Upon receiving of a signal of sufficient strength, frequency, and rate of change the desired result is effected. That is, the detonator is fired. The majority of the present day componential detector circuits have not operated entirely satisfactorily because of their design as averaging superregenerative-detectors, which detectors are unduly sensitive to inherent and spurious noise signals. The spurious signals picked up by the detector may be stray signals in the air or they may originate from a jamming transmitter.

Oscillator-detector systems of the type related to the present invention are utilized in transceiver systems, particularly those systems which relate to the detection of moving objects or targets, for example the pulse-doppler proximity fuze. Although the prior art oscillator-detector circuits have, in the past, been employed in proximity fuzes, their performance leaves much to be desired in such applications. In addition to the limitations caused by inherent and stray signals, the effectiveness of this device has been limited by the detector responding to a false signal emitted from a jamming transmitter. Whenever the signals from the said transmitter exceed the energy level of the reflected target signal a complete operational failure of the fuze results.

Adjunctive circuits and power supply to overcome these operational limitations have been found to be too complex and bulky for ordnance fuzing applications.

Accordingly, a principal object of the instant invention is the provision of a new and improved high frequency oscillator-detector circuit.

Another object of the present invention is the provision of a new and improved peak detecting circuit.

A further object of the instant invention is the provision of a novel peak signal detector system responsive to variations in the peak amplitudes of successively self generated radio frequency impulses but invulnerable to signals from certain types of jamming transmitters.

A still further object of the present invention is to provide a new and improved electromagnetic energy impulse detecting system having operational characteristics substantially insensitive to inherent and spurious signals from any other source.

Other objects and many of the attendant advantages of this invention will be readily appreciated as the same becomes better understood by reference to the following detailed description when considered in connection with the accompanying drawing wherein.

Figure 1:
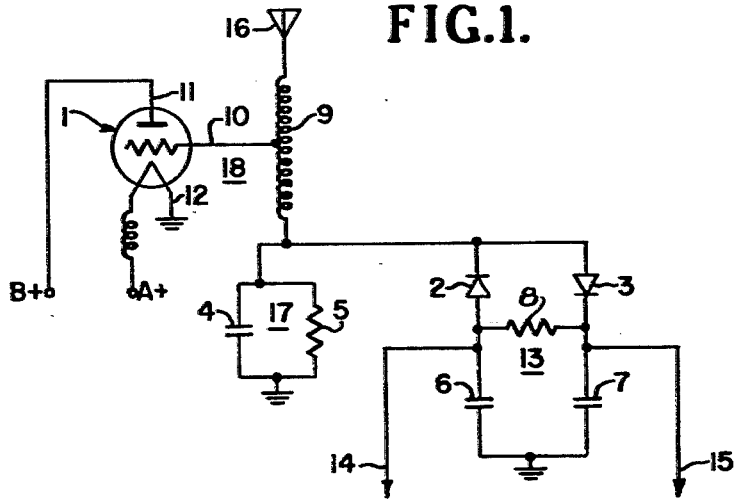
FIG. 1 is a schematic wiring diagram of the oscillator-detector circuit according to the present invention.

Referring now to the drawing, wherein like reference characters indicate like parts throughout the several views and more particularly to FIG. 1, wherein the oscillator-detector circuit of the present invention is generally indicated, the circuit includes an electron tube 1 such for example as a triode, with the plate and filament connected to an operating potential source. The triode 1 is connected in a high frequency oscillator circuit which utilizes a portion 9 of antenna coupling as the oscillator frequency determinative resonant network. The tank coil 9 electrically couples grid 10 of tube 1 to the grid biasing network 17 comprising resistor 5 and capacitor 4.

Figure 2:
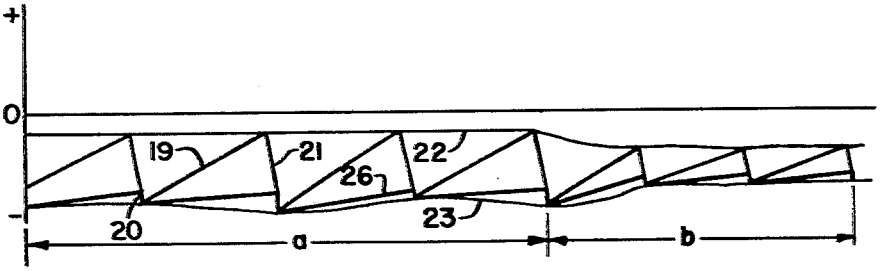
FIGS. 2 and 3 are graphical illustrations of certain waveform characteristics of the circuit of FIG. 1, as hereinafter to be more fully described.

The oscillator 18 is a modified Colpitts blocking oscillator. The R.C. network 17 in the grid circuit 10 causes it to block, as is well known in the art. A negative going sawtooth voltage is developed on the grid side of the R.C. combination at the bottom of the tank coil as is illustrated in FIG. 2.

The upper edge of the sawtooth envelope 22 is the grid voltage at which the oscillations swing into the positive voltage region and begin oscillations. The lower edge of the sawtooth envelope 23 is the voltage at which the oscillator tube stops conducting.

The detector unit 13 is connected to the high frequency oscillatory circuit from the grid side of the R.C. circuit and is responsive to the sawtooth voltage developed by this circuit. Diode 2 conducts on the peak of this sawtooth voltage charging capacitor 6. This capacitor discharges through resistor 8 and charges capacitor 7 until it reaches a critical voltage at which time it is discharged thru diode 3. The RC network detector circuit 13 is designed in such a manner that it will detect both edges of the sawtooth wave. Diode 3 is conducting on the voltage peaks of the upper edge 22, the other diode (2) conducts on the voltage peaks of the lower edge 23. The sawtooth voltage is developed entirely in the negative voltage region however, one diode biases the other, so that the voltage at the top of the smoothing capacitors 7 and 6 is automatically held at the voltage of the upper and lower sides of the sawtooth envelope as illustrated by 22 and 23 of FIG. 2.

The frequency of the sawtooth wave is proportional to the time constant of the RC grid network.

Figure 3:
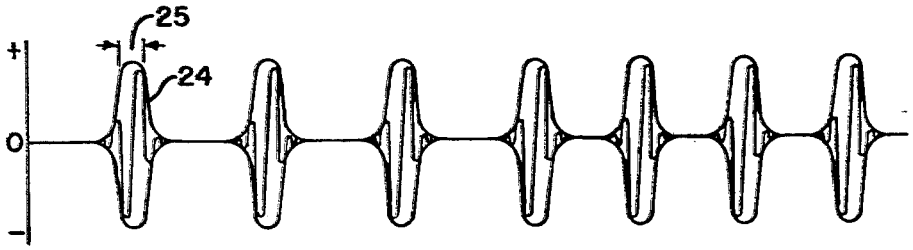
Figure 4:
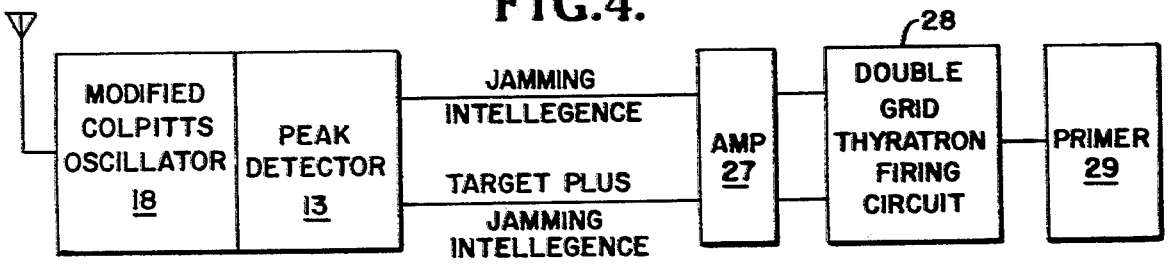
FIG. 4 is a diagrammatic view illustrating the use of the novel circuit, as more fully described herein, in a pulse doppler proximity fuze system.

Referring now to FIG. 4 of the drawing, the use of the novel oscillator-detector 18 and 13 respectively in a transceiver system such for example as a pulse doppler proximity fuze for which use the novel circuit is especially suited, is illustrated. As shown thereon, the modified Colpitts oscillator 18 is coupled to a suitable electromagnetic energy radiator, or antenna 16 which will radiate into the surrounding spatial region. The intermittent high frequency impulses, shown in FIG. 3, are generated by this oscillator. The presence of a suitable target in the surrounding spatial area will result in a reflection of a portion of the radiated pulse which will be intercepted by the antenna 16. The reflected signal will effect a variation in the antenna radiation resistance, which in turn will result in a loading of oscillator circuit 18. If the reflected signal is received while the original impulse 24 is still being generated, the loading of the oscillator circuit will effect a variation in the amplitude of the pulse being developed. It will be understood that the duration of the generated impulse 24 is preselected so that only electromagnetic energy reflected from a target within lethal range will effect the generated impulse during the peak portion 25 thereof. This amplitude variation will in turn proportionally vary the amplitude 20 of sawtooth signal 26 of peak detector 13 in a manner which results in the development of a sinusoidally varying audio frequency, often referred to as the "doppler frequency" having an envelope 23. As the distance between the proximity fuze and the reflecting target shortens, the amplitude of target signal will approach a predetermined magnitude whereupon the amplifier will develop an output signal having an amplitude suitable for actuating a double grid thyratron firing circuit 28. The oscillator begins oscillations from "seed" noise in its own tank system as soon as the negative voltage at the grid has decayed to a low enough value to permit the tube to conduct and begin oscillating. If, however, the tank coil is in a field that has a frequency close to the resonant frequency of the tank coil, an RF voltage will be induced in the coil. This RF voltage will appear at the grid of the tube. If the positive peak of the RF voltage is large enough to overcome the negative voltage at the grid due to discharge of the grid condenser, the oscillator will start oscillating before the voltage at the condenser has reached the value at which oscillations would begin in a field of free space. A foreign field has two effects on the sawtooth wave, as shown in FIG. 2.

First, it increases the frequency because it drives the oscillator into oscillation at a more negative point on the RC discharge curve shown in section a; and Second, inasmuch as the upper edge of the sawtooth envelope 22 is the RC grid voltage at which the oscillator begins its oscillations the presence of a foreign field causes this edge to be driven in a more negative direction as shown by section (b).

Foreign fields have the same effect on the lower edge of the sawtooth envelope 23 as do target signals.

From the foregoing it is evident that foreign fields modulate both edges of the sawtooth envelope. Target signals modulate only the lower edge. If then upper and lower edges of the sawtooth are separately detected, information as to the presence of foreign fields only is available from side 15 of the detector that is detecting modulation on the upper edge of the sawtooth wave. Further, modulation of the upper edge is always negative going from the field free space level. This information is not available in any existing projectile fuze system. The foreign field information and the target signals are fed into a double grid thyratron (not shown) in such a manner that the thyratron will only fire on target signals coming from the lower edge detector 14.

Actuation of the thyratron firing circuit results in the ignition of an electroresponsive primer 29 whereupon the fuze will be detonated within lethal proximity of the target.

From the foregoing description of the pulse doppler proximity fuze, utilizing the novel modified Colpitts oscillator 18 and peak detector 13 of the instant invention, a sensitive proximity fuze that is not vulnerable to jamming by an outside field has been developed. The foreign field or jamming transmissions increase the oscillator blocking frequency and the target signal is readily detected having an amplitude 20 in a sawtooth waveform having a large amplitude 21. Also, by reason of the relatively short duty cycle of the R.F. pulse, a pulse doppler proximity fuze has been developed with a range cut-off feature. This means that the detector will not respond to target signals beyond a maximum distance depending on the R.F. pulse of the oscillator.

As a result this device is insensitive to reflected signals from targets beyond the effective lethal range of the fuze and will not be detonated prematurely by a false signal from a jamming transmitter.

Obviously many modifications and variations of the present invention are possible in the light of the above teachings. It is therefore to be understood that within the scope of the appended claims the invention may be practiced otherwise than as specifically described.

What is claimed as new and desired to be secured by Letters Patent of the United States is:

1. An oscillator-detector circuit comprising an oscillatory circuit for generating high frequency electromagnetic impulses of a predetermined amplitude, said circuit including an electron discharge device having at least a filament, control grid and plate electrodes, antenna means electrically connected to the oscillatory circuit for radiating said generated electromagnetic impulses and for receiving any reflected electromagnetic impulses, a detector electrically connected to said antenna for selectively detecting variations in the amplitude of the said generated impulses resulting from said reflected impulses and other spurious impulses, the said detector comprising a pair of diodes and a pair of capacitors connected in a bridge, a diode connected in each of the legs of the upper portion of the said bridge and a capacitor connected in each of the legs of the lower portion of said bridge, a resistor connected across the midpoints of the bridge to form long time constant means with said capacitors and circuit means connecting said midpoints to an amplifier for transmitting intelligence signals thereto.

2. An oscillator-detector system comprising a modified Colpitts oscillator for generating high frequency energy impulses in the presence of a foreign magnetic field, an antenna means coupled to said oscillator for radiating impulses and for receiving reflected impulses from a target or spurious impulses caused by said field, an impulse repetition rate determinative network coupled to said antenna for providing a sawtooth wave signal at the output thereof having its negative peaks modulated when said antenna receives reflected target signals and having both positive and negative peaks modulated when said antenna is subjected to said foreign field, a detector coupled to said impulse repetition rate determinative network, said detector having a pair of capacitors and a pair of diodes connected in a bridge circuit and means coupled to one of said diodes for providing target information and foreign field information and means connected to the other of said diodes providing foreign field information only.

3. An oscillator-detector circuit according to claim 2 wherein the oscillator includes an impulse repetition rate determinative network comprising a parallel connected resistance and capacitance having a preselected time constant characteristic.

4. In an oscillator-detector circuit comprising a blocking oscillator circuit for generating electromagnetic energy impulses at a preselected pulse repetition rate, said circuit including an RC network across which a sawtooth signal is developed, an electromagnetic energy radiator coupled to said circuit for radiating said generated energy impulses into space and for intercepting any target impulses reflected and other electromagentic energy impulses impinging thereon, a pair of detectors coupled to said oscillatory circuit for uniquely detecting variations in the upper and lower edges of said developed sawtooth signal, circuit means for utilizing the target signals detected from the lower edge of the sawtooth wave, and additional circuit means for utilizing the other electromagnetic energy impulses detected from the upper edge of the sawtooth wave.

5. A pulse doppler proximity fuze comprising a self-pulsing oscillator for developing a series of radio frequency electromagnetic energy impulses, an antenna electrically connected to said oscillator for radiating said impulses into space and for intercepting reflected impulses thereby to effect a variation in the amplitude of said impulses, a pair of detectors electrically connected to the said oscillator circuit for developing an output signal in proportion to the energy of the said reflected signal during the peak amplitude of said impulse, a thyratron firing circuit said detectors having means for detecting spurious signals and target signals but utilizing only the target signals for firing the thyratron firing circuit; and an electroresponsive ignition device electrically coupled to the thyratron firing circuit, said device being ignitable upon actuation of the thyratron firing circuit by said target signal.

* * * * *